US008052924B2

(12) United States Patent
Kim et al.

(10) Patent No.: US 8,052,924 B2
(45) Date of Patent: Nov. 8, 2011

(54) HIGH STRENGTH STEEL PLATE WITH HIGH MANGANESE HAVING EXCELLENT BURRING WORKABILITY

(75) Inventors: Sung Kyu Kim, Gwangyang (KR); Kwang Geun Chin, Gwangyang (KR)

(73) Assignee: Posco (KR)

( * ) Notice: Subject to any disclaimer, the term of this patent is extended or adjusted under 35 U.S.C. 154(b) by 481 days.

(21) Appl. No.: 12/298,935

(22) PCT Filed: Dec. 20, 2007

(86) PCT No.: PCT/KR2007/006675

§ 371 (c)(1), (2), (4) Date: Oct. 29, 2008

(87) PCT Pub. No.: WO2008/078904

PCT Pub. Date: Jul. 3, 2008

(65) Prior Publication Data

US 2009/0317284 A1 Dec. 24, 2009

(30) Foreign Application Priority Data

Dec. 26, 2006 (KR) ..... 10-2006-0134128

(51) Int. Cl.
*C22C 38/04* (2006.01)

(52) U.S. Cl. ..... 420/72; 148/329

(58) Field of Classification Search ..... 148/329, 148/619, 620; 420/72–76
See application file for complete search history.

(56) References Cited

U.S. PATENT DOCUMENTS

| | | | | |
|---|---|---|---|---|
| 4,855,105 | A | 8/1989 | Svidunovich et al. | |
| 5,431,753 | A * | 7/1995 | Kim et al. | 148/620 |
| 2009/0165897 | A1 | 7/2009 | McEwan | |

FOREIGN PATENT DOCUMENTS

| | | | |
|---|---|---|---|
| EP | 0573641 | B1 | 12/1993 |
| JP | 02104633 | A | 4/1990 |
| JP | 10121204 | A | 5/1998 |
| KR | 19950026569 | A | 10/1995 |
| WO | 2005019483 | A1 | 3/2005 |
| WO | 2006082104 | A1 | 8/2006 |

* cited by examiner

*Primary Examiner* — George Wyszomierski
*Assistant Examiner* — Mark L Shevin
(74) *Attorney, Agent, or Firm* — The Webb Law Firm

(57) ABSTRACT

There is provided a high strength steel plate with high manganese having excellent burring workability, which is used for structural members, bumper reinforcing materials and impact absorbing materials of automobiles, etc. The high strength steel plate includes, by weight: C: 0.2 to 1.0%, Mn: 10 to 25%, Al: 0.3 to 3.0%, S: 0.05% or less, P: 0.05% or less, and the balance of Fe and inevitable impurities, wherein the chemical elements satisfactorily have a grain size of 18 μm or more. The high strength steel plate can be useful to facilitate formation of automobile parts since it has excellent physical properties such as elongation and hole expansibility as well as strength.

2 Claims, 3 Drawing Sheets

[Fig. 1]
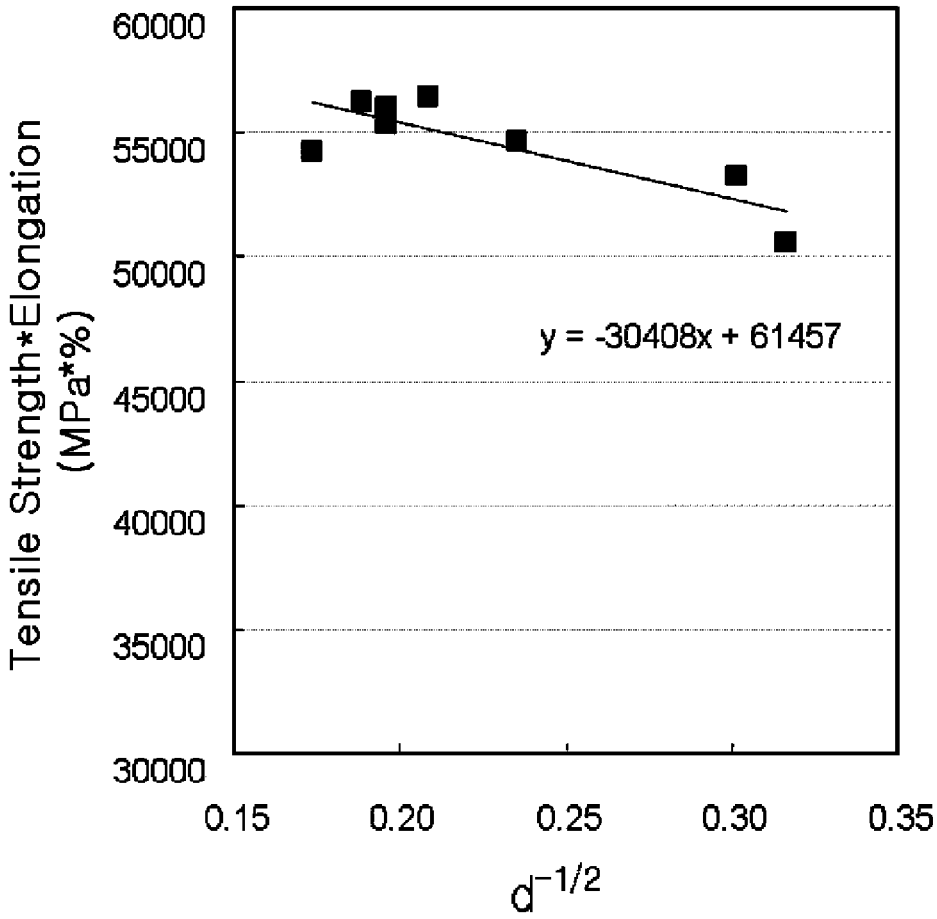

[Fig. 2]
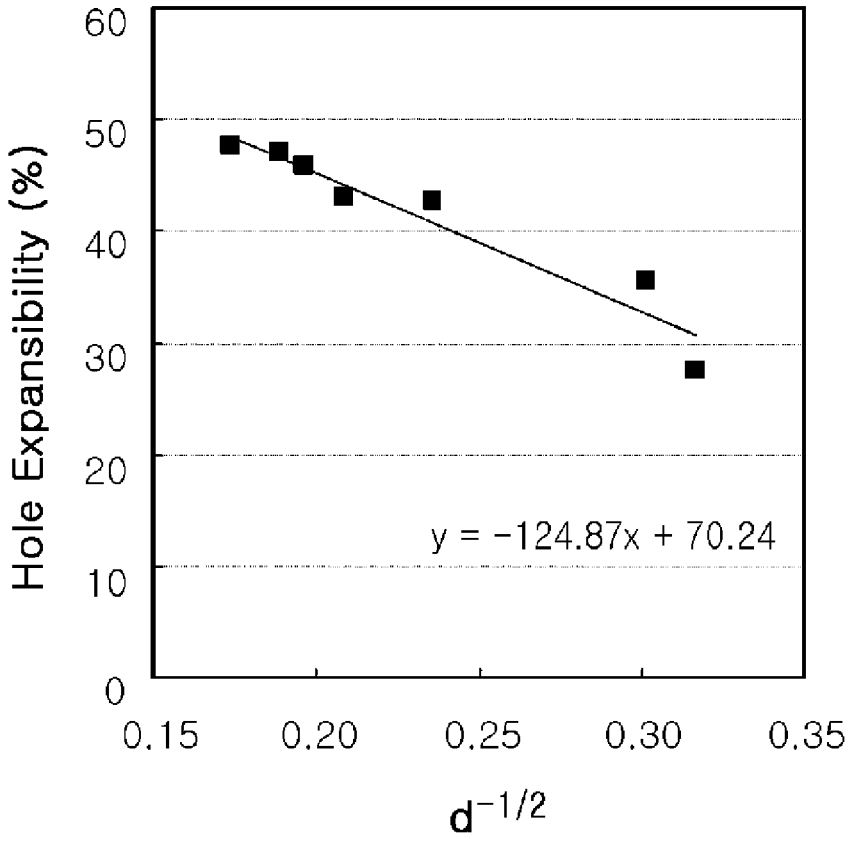

[Fig. 3]
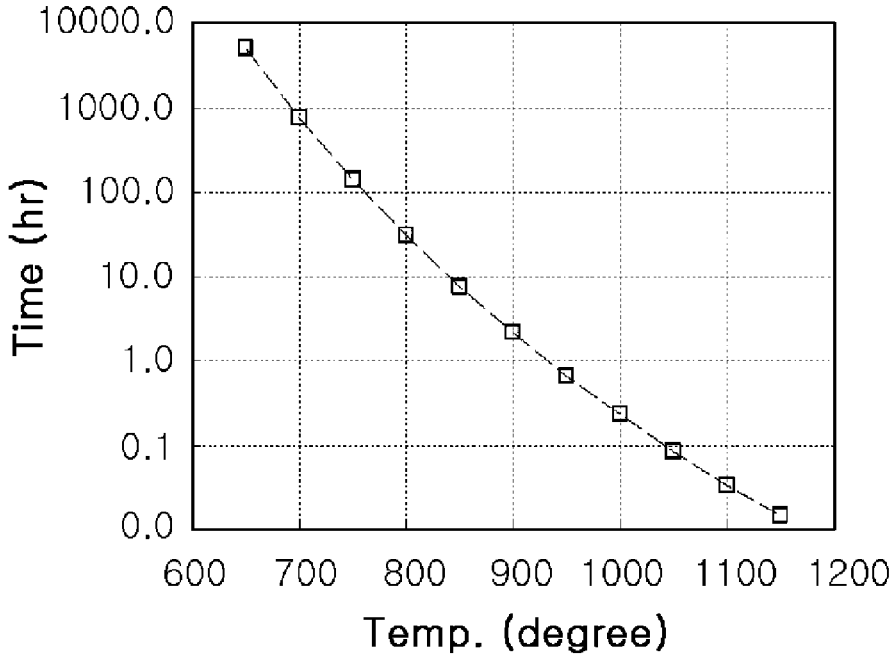

HIGH STRENGTH STEEL PLATE WITH HIGH MANGANESE HAVING EXCELLENT BURRING WORKABILITY

TECHNICAL FIELD

The present invention relates to a high strength steel plate with high manganese having excellent burring workability, which is used for structural members, bumper reinforcing materials and impact absorbing materials of automobiles, etc., and more particularly, to a high strength steel plate with high manganese whose physical properties such as strength, elongation and hole expansibility are improved by adding C, Mn and Al to control its microstructure.

BACKGROUND ART

Bumper reinforcing materials or indoor impact absorbing materials are directly associated with the safety of passengers in vehicle collisions, and therefore the ultra high strength hot rolled steel plates having a tensile strength of 780 MPa or more have been widely used as the reinforcing/absorbing materials. Also, the reinforcing/absorbing materials should have high elongation as well as high tensile strength, and its excellent hole expansibility is required to improve formability of a flange unit or a part coupling unit.

For the purpose of coping with regulation for increasingly serious environmental pollution problems, high strength steel has been increasingly used in high strength parts to improve fuel efficiency, and therefore there has been an increasing attempt to commercialize a high strength steel having a tensile strength of 780 MPa or more.

Representative examples of the high strength steel used for automobiles include a multi-phase steel, dual-phase (DP) steel, a transformation induced plasticity (TRIP) steel and a twin induced plasticity (TWIP) steel.

In general, a method for manufacturing a plate sheet is divided into a re-heating process for re-employing segregated components of manufactured slabs, a hot rolling process for rolling the slabs into plates of a final thickness, and a cooling process for cooling/winding the hot-rolled plate at room temperature. Here, the slabs taken out from a heating furnace are rolled in an austenite zone, and austenite is then transformed into martensite at a lower finish cooling temperature than a martensite start (Ms) temperature in the cooling process. At this time, the resultant steel is referred to as a dual-phase steel.

The dual-phase steel has an increasing strength with the increase in the ratio of martensite over the entire structure, and also has an increasing ductility with the increases in the ratio of ferrite. In this case, when the ratio of martensite is increased to enhance its strength, the ratio of ferrite is relatively decreased, which leads to the deteriorated ductility. And, the dual-phase steel has a problem that its cooling rate should be increased to form martensite at low temperature.

As described in the method, the austenite is formed in the rolling process, and the ferrite, the martensite, some of the bainite and a mixed martensite/austenite phase are formed at room temperature by controlling the cooling rate, the finish cooling temperature and so on in the cooling process. The resultant steel that improves strength and ductility of the transformation induced plasticity steel is a multi-phase steel.

The multi-phase steel does not have a yield ratio characteristic caused by the martensite transformation, and therefore the multi-phase steel has been widely used in a variety of application fields since it has excellent weldability due to the use of a relatively low amount of added alloy elements, and also has high yield strength although its formability is rather unfavorable because of the high yield strength.

Also, after the austenite, the austenite or the ferrite dual phase is formed in the rolling process, and then heat-treated in the bainite transformation temperature range by controlling the cooling rate and the finish cooling temperature in the cooling process, the transformation induced plasticity steel may be manufactured when the condensed austenite remains metastable at room temperature in addition to the bainite transformation. Amongst the currently commercially available steels, the transformation induced plasticity steel has the most excellent strength and elongation balance (strength*elongation).

Considering the steels that are under the commercial use stage, the twin induced plasticity steel has the most excellent strength*elongation balance. The twin induced plasticity steel is a steel whose strain hardening property is improved, thereby suppress necking and improve elongation, by adjusting components such as manganese, carbon and aluminum to obtain a stable austenite single phase and using dislocation and twin systems as the transformation apparatus during the phase transformation.

However, when the martensite is subject to the strain hardening process, boundaries of soft matrix phases and hard martensite phases are sufficient to form vacancies during the phase transformation or processing process, and therefore its strength vs. elongation is excellent but its hole expansibility is poor.

The transformation induced plasticity steel has a low burring workability since vacancies are also formed in boundaries of transformation induced martensite and soft matrix phase during the phase transformation. The twin induced plasticity steel has the same or similar level of hole expansibility, compared to the ultra high strength steel (dual-phase steel, transformation induced plasticity steel, etc.) of the same strength, which is considered to be associated with the high strain hardening rate caused by the twin.

SUMMARY OF THE INVENTION

An aspect of the present invention provides a high strength steel plate with high manganese having an elongation of 50% or more, a TS×El balance of 50,000 MPa×% or more, and a hole expansibility of 40% or more by adjusting contents of C, Mn and Al and controlling its microstructures.

According to an aspect of the present invention, there is provided a high strength steel plate with high manganese having excellent burring workability, including, by weight: C: 0.2 to 1.0%, Mn: 10 to 25%, Al: 0.3 to 3.0%, S: 0.05% or less, P: 0.05% or less, and the balance of Fe and inevitable impurities, wherein the chemical elements satisfactorily have a grain size of 18 μm or more.

An aspect of the present invention can provide a high strength steel plate capable of being used to facilitate formation of automobile parts since it has excellent physical properties such as elongation and hole expansibility as well as strength.

BRIEF DESCRIPTION OF THE DRAWINGS

FIG. 1 is a graph illustrating a correlation, of grain size and tensile strength*elongation of test samples prepared according to one exemplary embodiment of the present invention;

FIG. 2 is a graph illustrating a correlation of grain size and hole expansibility of test samples prepared according to one exemplary embodiment of the present invention; and FIG. 3 is a graph illustrating heat treatment times with the increasing temperature as to obtain the same effects under the conditions of 1100° C. and 2 minutes.

BEST MODE FOR CARRYING OUT THE INVENTION

Hereinafter, exemplary embodiments of the present invention will be described in detail with reference to the accompanying drawings.

The present inventors have made ardent attempts to develop an ultra high strength steel having excellent hole expansibility, as well as excellent strength and elongation. A stable austenite structure was manufactured by adding a large amount of C and Mn so as to give excellent elongation, and a necking phenomenon was inhibited by forming a twin during the phase transformation. Also, the local elongation was increased by adding Al to control a proportion of the twin. As a result, the hole expansibility of the inventive high strength steel plate is increased by 15%, compared to the aluminum-free steels, thereby ensuring about 30% hole expansibility.

However, the high strength steel plate needs to have higher hole expansibility to apply to automobile parts, that is, the higher the hole expansibility is, the more desirable it is. However, the high strength steel plate is considered to require up to about 40% hole expansibility. Accordingly, the present invention has been proposed on the basis of the fact that it is possible to ensure high hole expansibility as well as strength and elongation by adjusting the contents of C, Mn and Al, and making their grain sizes coarse by heat treatment.

Hereinafter, contents of the components in the high strength steel plate according to the present invention will be described in detail.

A content of carbon (C) is preferably in a range from 0.2 to 1.0%.

The carbon (C) is one of the most important components in steels, which is closely associated with all physical and chemical properties such as toughness, corrosion resistance as well as strength, etc., and has the greatest effect on the physical properties of the steel. Stability of austenite may be lowered and the proportion of the dual phase may be decreased when the content of the carbon (C) is less than 0.2%, whereas processability may be suddenly deteriorated due to the low weldability and the sudden increase in the proportion of the dual phase when the content of the carbon (C) exceeds 1.0%. Therefore, it is preferred to limit the content of the carbon (C) to a range from 0.2 to 1.0%.

A content of manganese (Mn) is preferably in a range from 10 to 25%.

The manganese (Mn) is an austenite stabilizer that increases strength of steel by enhancing hardenability of the steel. At least 10% of manganese should be present in the steel to obtain a stable austenite structure. Here, seriously increased loads on the steel-making process and deteriorated weldability may be caused, and inclusions may also be formed when the content of the manganese (Mn) exceeds 25%. Accordingly, it is preferred to limit the content of the manganese (Mn) to a range from 10 to 25%.

A content of aluminum (Al) is preferably in a range from 0.3 to 3.0%.

The aluminum (Al) is a ferrite dual stabilizer that contributes to improving strength of steel and is generally added as a deoxidizing agent. Meanwhile, the aluminum continues to generate twins during the phase transformation by increasing a stacking fault energy. Effects on the stacking fault energy may be low if the content of the aluminum (Al) is less than 0.3%, whereas a nozzle clogging phenomenon or mixed inclusions may be increasingly caused during the steel-making and casting processes when the content of the aluminum (Al) exceeds 3.0%. It is preferred to limit the content of the aluminum (Al) to a range from 0.3 to 3.0%.

A content of sulfur (S) is preferably in a range of 0.05% or less.

When the content of sulfur (S) exceeds 0.05%, coarse MnS is formed on a hot-rolled plate, which leads to the deteriorated processability and toughness. Therefore, the sulfur (S) is preferably added in an amount as low as possible.

A content of phosphorus (P) is preferably in a range of 0.05% or less.

When the content of phosphorus (P) exceeds 0.05%, coarse MnS is formed on a hot-rolled plate, which leads to the deteriorated processability and toughness. Therefore, the phosphorus (P) is preferably added in an amount as low as possible.

The composition prepared according to the present invention includes the balance of Fe and the other inevitable impurities in addition to the above-mentioned components.

The steel plate according to the present invention satisfies requirements for a grain size of 18 μm or more so as to ensure excellent burring workability.

Quality of the high manganese steel with an austenite single phase structure is determined by the austenite grain size, as well as the stability and stacking fault energy of the austenite. The stability of the austenite increases with the increasing contents of manganese, nickel and carbon, resulting in the excellently improved quality of the high manganese steel. And, the stacking fault energy increases with an increasing content of aluminum, thereby generating twins over the transformed steel and increasing elongation of the steel.

The grain size of the ultra high strength steel with high manganese has close relation to hole expansibility. In general, a plate prepared according to the hot and cool rolling processes has an average grain size of 8 μm. Here, the average grain size of the plate is rather increased by changing the hot rolling temperature or the annealing temperature, but it is difficult to prepare a steel having an average grain size of 10 μm or more.

According to the present invention, various methods may be used to ensure an average grain size of 18 μm or more, for example, to control a grain size through the heat treatment, etc. The cooling process after the heat treatment may be carried out in a furnace cooling or air cooling manner since the grain size control is related to the high maintenance temperature and time in consideration of activation energy, and the cooling at a rate of 1° C./sec or more may make it possible to control a phase structure.

Also, the grain size may be a grain size of the austenite single phase as a heat treated structure.

Hereinafter, exemplary embodiments of the present invention will be described in detail with reference to the accompanying drawings.

Examples

An ingot having components as listed in the following Table 1 was heated at 1,200° C. for 1 hour, hot-rolled at 900°

C., and then cooled to 680° C. with water. After the cooling of the ingot, test samples prepared under the conditions of heat treatment temperatures as listed in the following Table 2 were measured for strength, elongation and hole expansibility. The results are listed in the following Tables 2 and 3.

The heat treatment time to the heat treatment temperature was calculated using an activation energy required for recrystallization and the following equation. Considering that activation energy of the high manganese steel is 276,210 cal/mole, the heat treatment time was as shown in FIG. 3 when the heat treatment time was calculated under the same heat treatment condition as at 1100° C. and 2 minutes. Also, the cooling after the heat treatment was carried out in a furnace cooling or air cooling manner.

The grain growth rate is calculated according to the following equation. Here, "d" represents a grain size after the heat treatment, "$d_o$ represents a grain size before the heat treatment, "n" and "K" represents a constant of materials for the grain growth during the heat treatment, "Q" represents an activation energy, "R" represents a physical constant (a mantissa constant), and "T" represents a temperature.

$$d^n - d^n_o = Kt\exp(-Q/RT)$$

TABLE 1

| C | Mn | Al | S | P |
|---|---|---|---|---|
| 0.6% by weight | 18% by weight | 1.5% by weight | 0.05% by weight or less | 0.05% by weight or less |

TABLE 2

| | Heat Treatment Condition | | Yield Strength | Tensile Strength | Total Elongation | Difference between Total Elongation and Uniform | Uniform Elongation |
|---|---|---|---|---|---|---|---|
| | Temp. | Time | (MPa) | (MPa) | (%) | Elongation (%) | (%) |
| Comparative Example 1 | 800 | 2 | 434.78 | 824.56 | 61.24 | 3.70 | 57.54 |
| Comparative Example 2 | 900 | 2 | 411.01 | 819.92 | 64.87 | 6.69 | 58.17 |
| Inventive Example 3 | 1000 | 2 | 376.47 | 790.16 | 69.06 | 7.32 | 61.74 |
| Inventive Example 4 | 1100 | 2 | 343.43 | 753.72 | 73.36 | 7.50 | 65.86 |
| Inventive Example 5 | 1200 | 2 | 323.00 | 728.87 | 74.39 | 7.56 | 66.84 |
| Inventive Example 6 | 1100 | 1 | 351.66 | 771.71 | 73.1 | 6.52 | 66.62 |
| Inventive Example 7 | 1100 | 3 | 344.43 | 755.59 | 74.4 | 11.39 | 62.97 |

TABLE 3

| | Stretch Flanging Property (%) | YR (%) | TS × El (MPa × %) | AGS (d) (μm) | $D^{-1/2}$/ vμm |
|---|---|---|---|---|---|
| Comparative Example 1 | 27.60 | 52.73 | 50496 | 10.0 | 0.316 |
| Comparative Example 2 | 35.50 | 50.13 | 53186 | 11.0 | 0.302 |
| Inventive Example 3 | 42.60 | 47.64 | 54568 | 18.0 | 0.236 |
| Inventive Example 4 | 45.80 | 45.56 | 55289 | 26.0 | 0.196 |
| Inventive Example 5 | 47.6 | 44.31 | 54221 | 33.0 | 0.174 |
| Inventive Example 6 | 43.00 | 45.57 | 56443 | 23.0 | 0.209 |

As listed in the Table 2 and 3, in the case of the Inventive Examples 1 to 7 that meet the heat treatment conditions, it was revealed that the high strength steel plates according to the present invention have excellent burring workability, for example stretch flangeability of 42.6% or more, by ensuring an average austenite grain size (AGS) of 18 μm or more. It is preferred to increase hole expansibility by increasing grain size since the hole expansibility increases with an increasing difference between the total elongation and the uniform elongation. Also, the high strength steel plates according to the present invention exhibited excellent mechanical properties, for example a TS×El balance of 50,000 MPa×% or more, and an elongation of 50% or more.

However, in the case of the Comparative examples 1 and 2 that do not meet the heat treatment conditions, it was seen that the high strength steel plates exhibit an average austenite grain size (AGS) of 10 to 11 μm, and, thus, a deteriorated stretch flangeability.

The invention claimed is:

1. A high strength steel plate with high manganese comprising, by weight: C: 0.2 to 1.0%, Mn: 10 to 25%, Al: 0.3 to 3.0%, S: 0.05% or less, P: 0.05% or less, and the balance of Fe and inevitable impurities, wherein the steel has a grain size of 18 μm or more and a tensile strength*elongation (TS*El) of 50,000 MPa % or more.

2. The high strength steel plate of claim 1, wherein the grain size is a grain size of an austenite single phase as a heat-treated structure.

* * * * *